US012797925B2

(12) United States Patent
Kirchner et al.

(10) Patent No.: US 12,797,925 B2
(45) Date of Patent: Nov. 17, 2026

(54) SYSTEM FOR HOLDING BACK A MANDREL ROD IN A PIPE ROLLING MILL, AND METHOD FOR OPERATING SAID SYSTEM

(71) Applicant: SMS group GmbH, Düsseldorf (DE)

(72) Inventors: Walter Kirchner, Viersen (DE); Dominik Pohl, Mönchengladbach (DE); Frank Esser, Mönchengladbach (DE)

(73) Assignee: SMS group GmbH, Düsseldorf (DE)

( * ) Notice: Subject to any disclaimer, the term of this patent is extended or adjusted under 35 U.S.C. 154(b) by 324 days.

(21) Appl. No.: 18/697,787

(22) PCT Filed: Oct. 24, 2022

(86) PCT No.: PCT/EP2022/079617

§ 371 (c)(1),
(2) Date: Apr. 2, 2024

(87) PCT Pub. No.: WO2023/094089

PCT Pub. Date: Jun. 1, 2023

(65) Prior Publication Data

US 2025/0235913 A1 Jul. 24, 2025

(30) Foreign Application Priority Data

Nov. 26, 2021 (DE) ..... 10 2021 213 367.3
Mar. 18, 2022 (DE) ..... 10 2022 202 679.9

(51) Int. Cl.
*B21B 13/02* (2006.01)

(52) U.S. Cl.
CPC ..... *B21B 13/02* (2013.01)

(58) Field of Classification Search
CPC ..... B21B 17/06; B21B 25/00; B21B 25/02
See application file for complete search history.

(56) References Cited

U.S. PATENT DOCUMENTS

| | | | | |
|---|---|---|---|---|
| 2,535,949 | A | 12/1950 | Offutt | |
| 4,361,023 | A | 11/1982 | Blanquet et al. | |
| 2018/0169725 | A1* | 6/2018 | Strank | B21B 25/04 |
| 2020/0009625 | A1 | 1/2020 | Bucci et al. | |

FOREIGN PATENT DOCUMENTS

| | | | |
|---|---|---|---|
| EP | 0041907 | A1 | 12/1981 |
| WO | 2018158720 | A1 | 9/2018 |

* cited by examiner

*Primary Examiner* — Teresa M Ekiert
(74) *Attorney, Agent, or Firm* — Smartpat PLC

(57) ABSTRACT

A system that has a movable unit and an activating unit. The movable unit is equipped with at least one actuating element, which can be actuated using an actuator that is arranged on the movable unit. The activating unit includes an actuating mechanism for actuating the actuator for the actuating element. In order to simplify, reduce the cost of and make more flexible the energy supply to the actuator for adjusting the actuating element on the movable unit, the activating unit is installed in a stationary manner relative to the movable unit. At least one traction element is provided for transmitting the movement energy of the actuating mechanism to the actuator on the movable unit in the form of a traction force for adjusting the actuating element.

29 Claims, 12 Drawing Sheets

SYSTEM FOR HOLDING BACK A MANDREL ROD IN A PIPE ROLLING MILL, AND METHOD FOR OPERATING SAID SYSTEM

CROSS-REFERENCE TO RELATED APPLICATION

This application is a national stage application, filed under 35 U.S.C. § 371, of International Patent Application PCT/EP2022/079617, filed on Oct. 24, 2022, which claims the benefit of German Patent Applications DE 10 2021 213 367.3, filed on Nov. 26, 2021, and DE 10 2022 202 679.9, filed on Mar. 18, 2022.

TECHNICAL FIELD

The disclosure relates to a system comprising a movable unit and an activating unit that is stationary relative to the movable unit. At least one actuating element is arranged on the movable unit, which is actuated via an actuator. The actuator itself—and therefore also the actuating element—is actuated using an actuating mechanism, which is arranged on the activating unit and whose movement energy is transmitted to the actuator. The movable unit is, for example, a mandrel rod retaining device with the use of which mandrel rods can be moved towards or away from a pipe rolling mill as an internal support for a hollow block to be rolled. The mandrel rod retaining device can also be called a mandrel abutment. As an alternative to the mandrel rods for the aforementioned function, the mandrel rods can also be expanding or piercing mandrels for expanding or reducing the forming cross-section of a primary product.

BACKGROUND

In the prior art, the actuating of the actuators and thus the actuating elements is typically effected via electric or hydraulic actuating devices, which in each case are arranged on the movable unit, preferably in the immediate vicinity of the actuators to be actuated. The energy supply for such actuating devices on the movable units is then effected via an energy supply chain, for example a cable carrier, or a hose supply or the like. The known energy supply systems are limited in their possible accelerations, speeds and service life and have a considerable dead weight to be moved in addition to the movable unit. As a result, significantly more drive power often has to be installed than would be required for dynamic movement of the movable unit, which is also detrimental to the cycle time.

SUMMARY

The disclosure further develops a said known system and an associated known method for operating the system in such a manner that the energy supply to the actuator for the actuating element on the movable unit is simplified, made cheaper and made more flexible.

This is achieved with respect to the system in that the activating unit is installed in a stationary manner relative to the movable unit and that at least one traction element is provided for transmitting the movement energy of the actuating mechanism to the actuator on the movable unit for adjusting the actuating element.

The term "stationary" means fixed in one place.

The claimed traction element is much less susceptible to failure and therefore requires significantly lower maintenance costs than the energy supply devices commonly used in the prior art. The actuation of the actuators and thus the actuating elements on the movable unit is effected by superimposing the movement of the movable unit with the movement of the traction element caused by the actuating mechanism. Otherwise, there is no coupling of travel and adjustment forces.

In accordance with a first exemplary embodiment, the traction element is a rope, a wire, a chain, or a belt, for example a toothed belt or a V-belt. In this configuration, the traction element advantageously has a significantly lower dead weight than the supply devices known from the prior art. Due to the reduced mass, the drive power required overall for the movement of the movable unit and the energy supply device can be reduced compared to the prior art. Due to the reduced mass, greater accelerations and travel speeds of the overall system are also possible. The traction element is also flexible in this configuration. The flexibility enables an actuation of the actuators on the movable unit by the traction element in any position of the movable unit and at any point in time of its movement, regardless of its direction of movement. Of course, the traction element also enables an actuation of the actuators if the movable unit is at a standstill. Finally, the traction element in this configuration is also significantly less expensive than the energy transmission devices in the prior art.

In accordance with a further exemplary embodiment, the end of the traction element on the actuating element side is fastened to the actuator or the actuating element itself and its end facing away from the actuating element is fixed either to the movable unit or to the stationary activating unit or to a third location. The actuating mechanism of the stationary activating unit then acts as a tensioning and/or buffering device for the traction element and engages with the traction element between the two ends of the traction element. The actuating mechanism is actuated with a drive device or manually. It acts as a tensioning device in the respect that it exerts a traction force on the traction element, which is then transmitted to the actuator and the actuating element. Advantageously, the traction element is already under a pretensioning if the actuating mechanism exerts the traction force on the traction element; the traction force is then superimposed on the pretensioning in the traction element. The actuating mechanism acts as a buffer device in the respect that, due to its design, it absorbs/stores a certain length of the traction element.

The actuating mechanism typically comprises at least one, often a plurality of deflection rollers. If these fixed and/or displaceable deflection rollers have a mass concentration in their center, they have a low moment of inertia. This is advantageous in order to keep the actuating force of the actuators low, on the one hand, and to reduce wear on the traction element, on the other hand.

In accordance with a further exemplary embodiment, the traction element can be designed to be elastic and/or contain a damping element. The advantage of these two configuration options is that the force transmit is effected more evenly rather than backwards; this reduces the load on the components involved.

The provision of interchangeable connections of the traction element at at least one of its two ends offers the advantage that the traction element can be easily detached and, if necessary, also easily replaced as an interchangeable part.

In this connection, it is also advantageous if a further monitoring device is provided to monitor wear, abrasion, or elongation of the traction element in order to replace it on a timely basis.

Finally, it is advantageous if compensation elements are provided to compensate for an undesirable change in the length of the traction elements, for example due to "wearing out" or changed ambient temperatures.

Further advantageous configurations of the actuator, the traction element, the actuating element, and the actuating mechanism are the subject matter of the dependent claims.

DETAILED DESCRIPTION

The invention is described in detail below with reference to the aforementioned figures in the form of exemplary embodiments. In all figures, the same technical elements are designated with the same reference signs. A reference sign followed by one or two apostrophes refers to a first or second exemplary embodiment of the respective technical element. If a reference sign is used without a trailing apostrophe, the statement linked to the reference sign is generally valid, i.e. it applies regardless of a specific embodiment.

Figure 12:
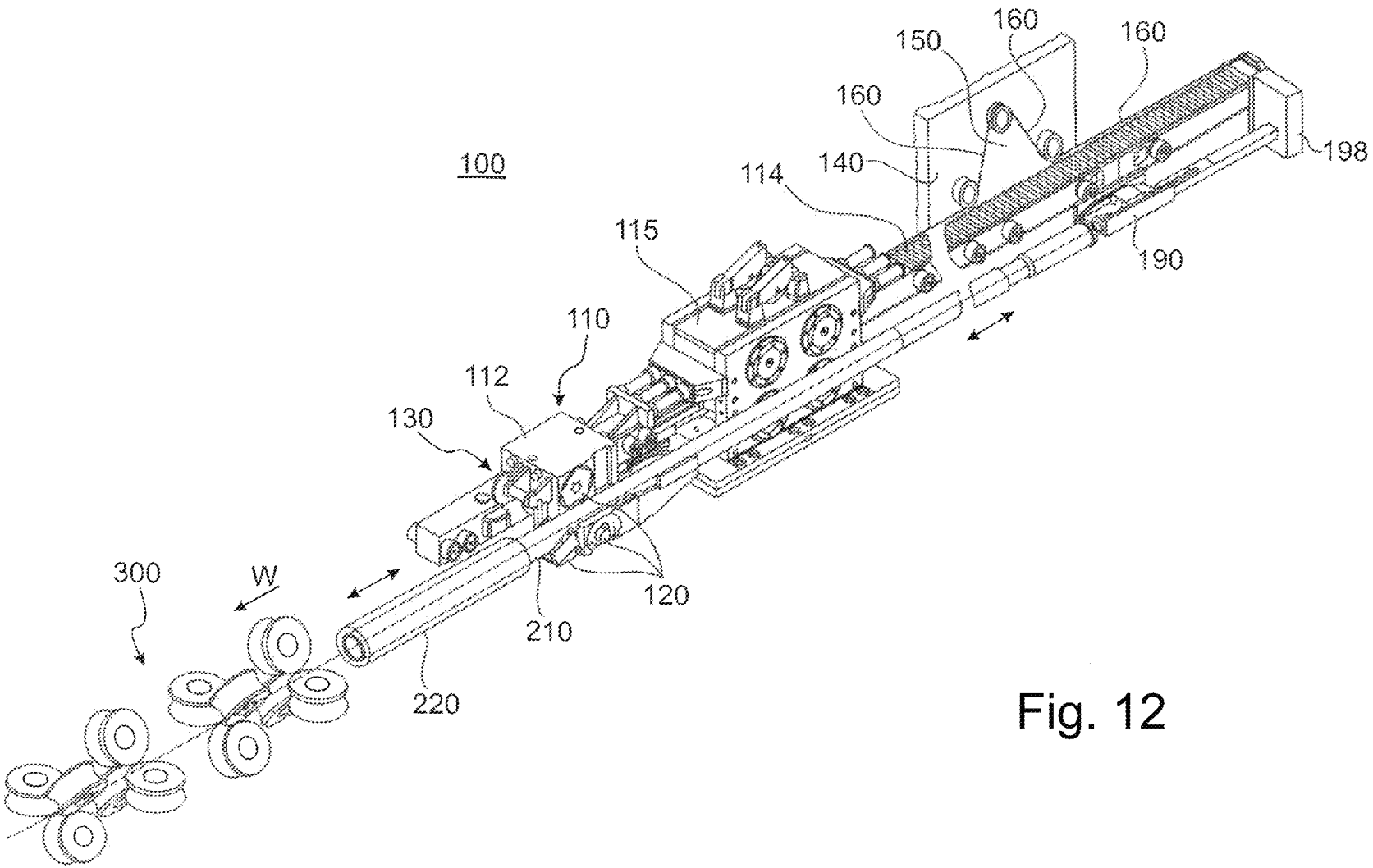
FIG. 12 shows the system in accordance with the disclosure in an overview.

FIG. 12 shows the system 100 in an overview. The two main components of the system can be seen, specifically the movable unit 110 and the activating unit 140, which is installed in a stationary manner relative to the movable unit.

The movable unit 110 has a mandrel rod retaining head 112 on which a mandrel rod 210 can be fixed/locked using actuating elements 120. The actuation of the actuating elements 120 is effected via assigned actuators 130. The activation of the actuators 130 is effected using actuating mechanisms 150 of the activating unit 140, whose movement energy is transmitted to the actuators 130 using the traction elements 160 and to the actuating elements via the actuators. The traction elements 160 can in each case be a rope, a wire, a chain, or a belt, for example a toothed belt or a V-belt.

The mandrel rod 210 primarily serves for insertion into a hollow block 220, if this is to be rolled into a pipe in a pipe rolling mill 300. The mandrel rod 210 then serves as an inner support for the hollow block. Alternatively, however, the mandrel rod can also be a so-called "plug rod" or "perforated mandrel rod" for expanding or reducing the forming cross-section of a primary product by means of a mandrel or perforated mandrel. In such cases, the mandrel rod retaining head 112 can also be called a mandrel abutment.

The mandrel rod 210 is translationally moved and positioned on the mandrel rod retaining head 112 using a push-in device 190, driven by a pusher drive device 198.

Figure 1:
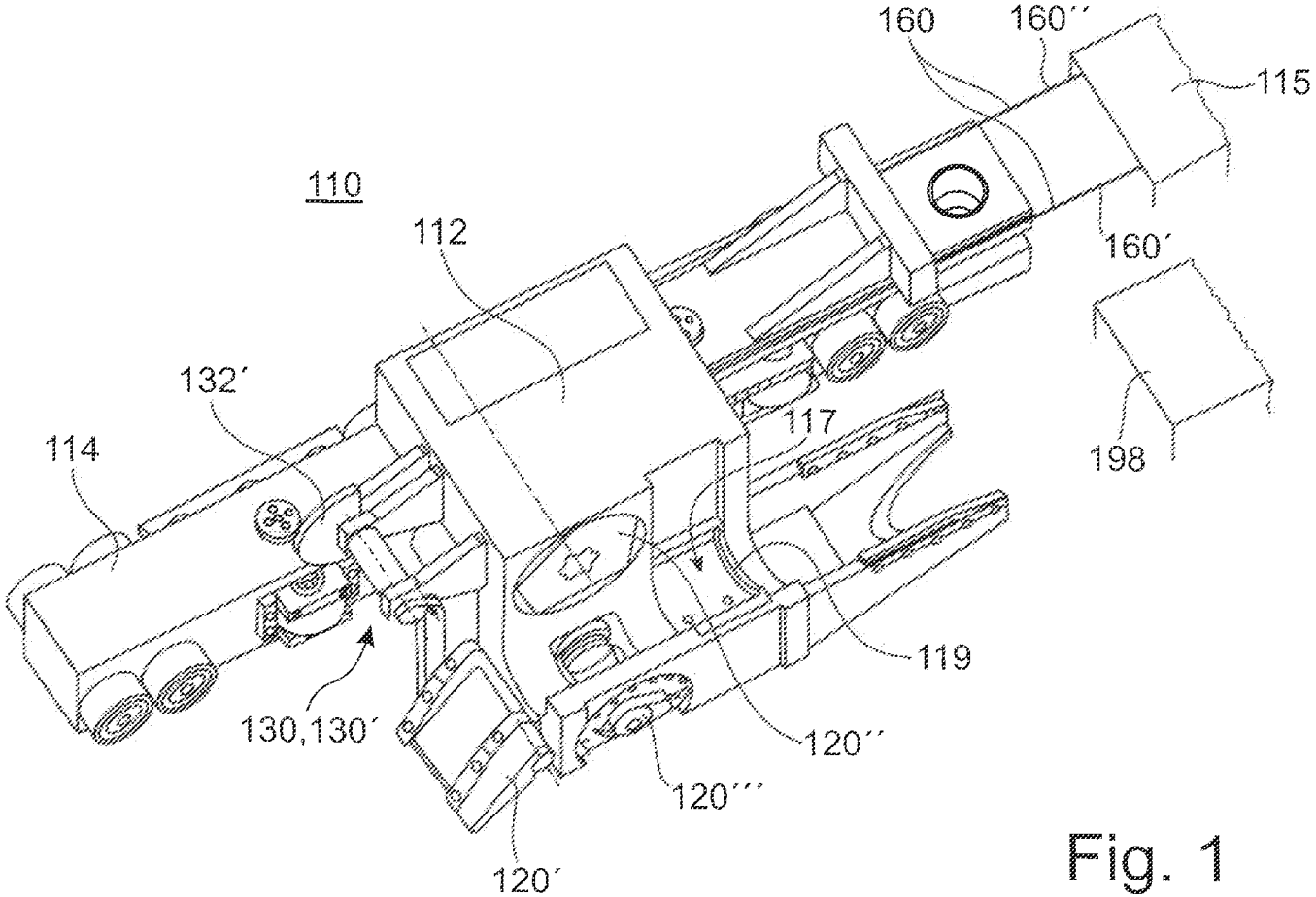
FIG. 1 shows a movable unit with a mandrel rod retaining head in perspective view in a state opened for inserting a mandrel rod.

In accordance with FIGS. 1 and 12, the mandrel rod retaining head 112 is firmly connected to a toothed rack 114. The toothed rack 114 and the mandrel rod retaining head 112 fastened thereto can be displaced in a translational manner in the axial direction of the toothed rack 114 towards and away from the pipe rolling mill 300 using a pinion drive device 115.

By way of example, three actuating elements 120', 120" and 120'" are arranged on the mandrel rod retaining head 112 in accordance with FIG. 1, of which at least the first and second actuating elements 120', 120" can be actuated by individually assigned actuators 130.

FIG. 1 illustrates a first exemplary embodiment of the actuator 130' in the form of a gear mechanism for the first actuating element 120'. As such a gear mechanism, the actuator 130' has a lever 132' on its input side, to which a first traction element 160' is connected. The lever 132' can be designed in the form of a rope pulley, as shown in FIG. 1, or a drum or a guide nozzle, if the first traction element 160' is a rope or a wire. If the first traction element 160' is a belt, in particular a toothed belt, it is advisable to design the lever 132' in the form of a belt pulley.

Under the sole influence of gravity, the first actuating element 120' in the form of a flap automatically folds downwards into its lowered position, as shown in FIG. 1. A pretensioning force is then transmitted from the output side of the gear mechanism to its input side and the traction element 160' is then pretensioned in this manner. The pretensioning effect of gravity can be supported/reinforced by additional aids such as springs, cylinders, or the like.

Figure 2:
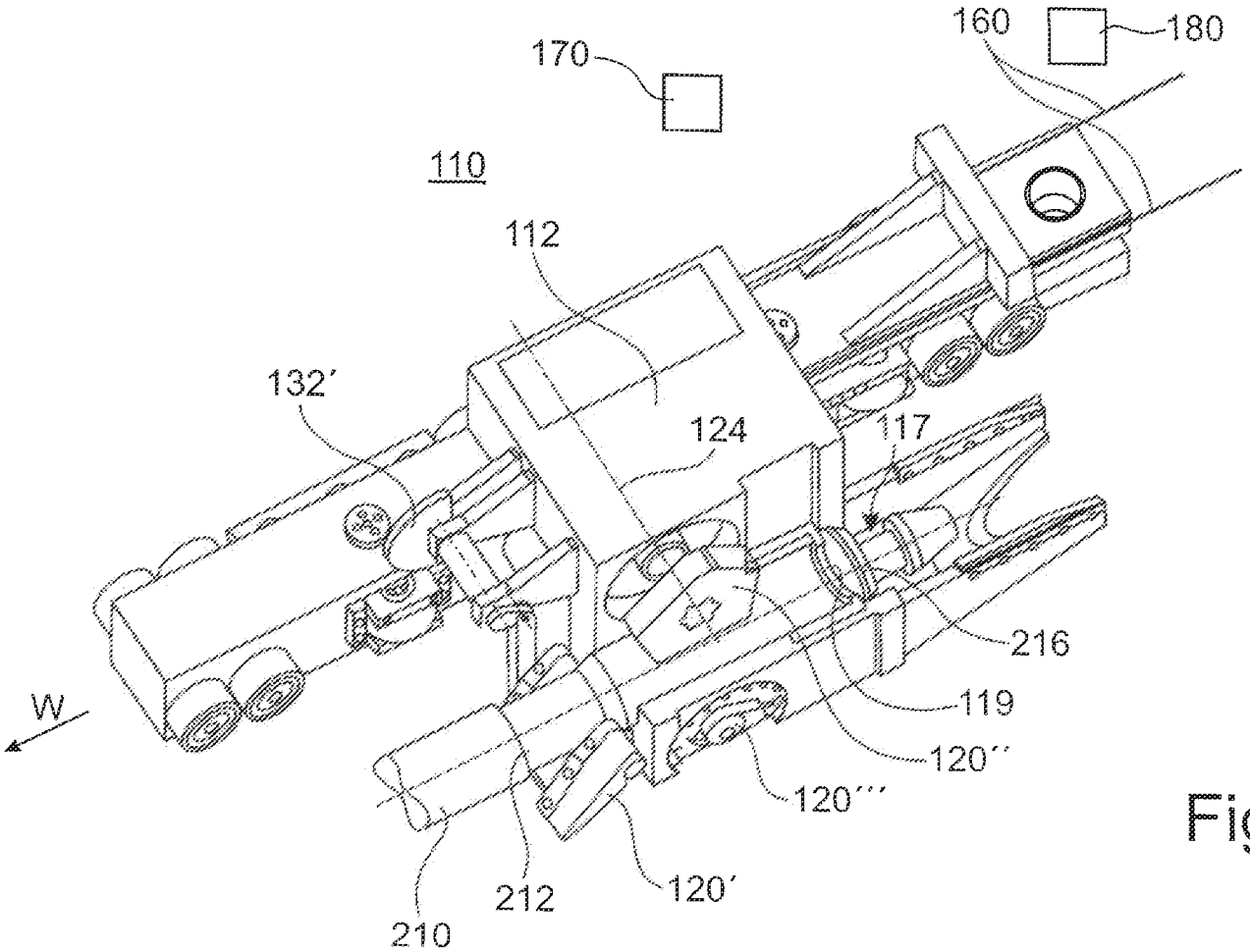
FIG. 2 shows the movable unit in accordance with FIG. 1 with the mandrel rod inserted and fixed radially and axially in the direction of rolling for a forward movement towards a pipe rolling mill.
Figure 11:
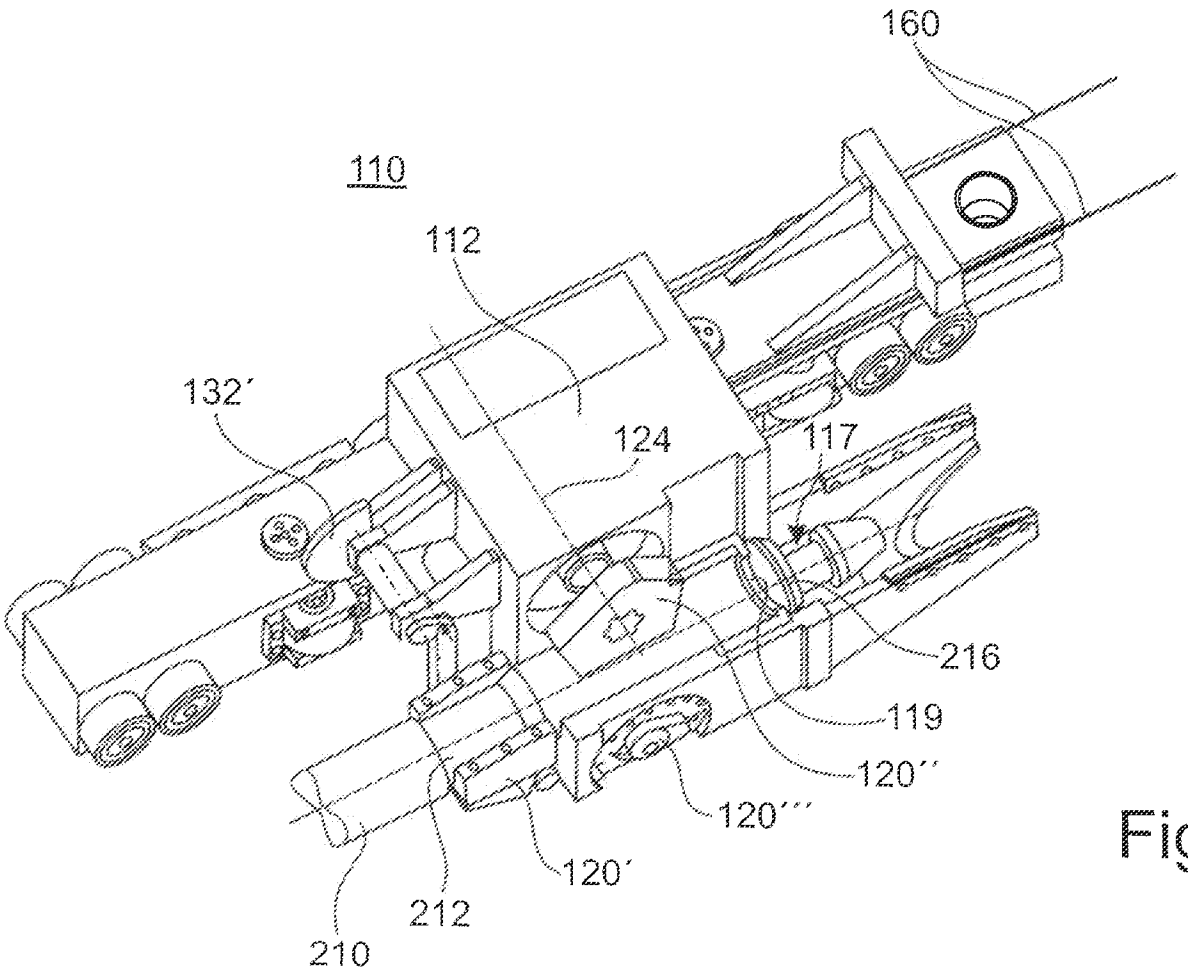
FIG. 11 shows the movable unit in accordance with FIG. 1 with the mandrel rod inserted and fixed radially and axially for a backward movement back from the pipe rolling mill in and against the direction of movement.

However, if, as described above, the first traction element 160' is subjected to an additional traction force using the first actuating mechanism 150, the gear mechanism transmits the traction force exerted by the traction element 160' from its input side to its output side, in order to fold up the flap 120' there from its lowered position shown in FIG. 2 to its raised position shown in FIG. 11. If the first traction element 160' is pretensioned as described, the applied traction force is superimposed with the oppositely directed pretensioning in the traction element 160'. The additional traction force must be great enough to overcome the opposing pretensioning and lift the flap.

The movable unit 110 and in particular the mandrel rod retaining head 112 serve to move the mandrel rod 210 into a hollow block 220 and to move the hollow block together with the inserted mandrel rod 210 into the pipe rolling mill 300. For this purpose, the mandrel rod 210 can be fixed to the mandrel rod retaining head 112 using the actuating elements 120. To accommodate the mandrel rod, a groove 117 is formed on the mandrel rod retaining head 112, into which the mandrel rod can be inserted or pushed. In the pipe rolling mill 300, the hollow block 220 is formed into a pipe with a desired reduced outer diameter compared to the hollow block 220. The hollow block 220 and the pipe produced from it are preferably designed to be seamless.

FIG. 2 shows the movable unit 110 and in particular the mandrel rod retaining head 112 in accordance with FIG. 1, but here with the mandrel rod 210 pushed in.

As soon as the hollow block 220 with the mandrel rod 210 is inserted into the pipe rolling mill 300, the pipe rolling mill 300 exerts a traction force on the hollow block and the mandrel rod 210; i.e. the mandrel rod 210 is pulled in the direction of the pipe rolling mill 300. The first actuating element 120' in the form of the flap is then typically folded down into its lowered position in accordance with FIG. 2. In such a case, the axial fixation of the mandrel rod 210 is effected on one side by a thickened end 216 on the head 214 of the mandrel rod. With the thick end 216, the mandrel rod then strikes against a stop 119 within the groove 117. The thickened end can be created, for example, by a constriction of the mandrel rod. With the thickened end 216, the traction force built up by the pipe rolling mill is transmitted and prevents the mandrel rod from bolt uncontrollably in the direction of the pipe rolling mill, thereby causing damage.

After the final rolling of the hollow block 220 in the pipe rolling mill 300, the mandrel rod 210 is pulled back from the pipe rolling mill using the movable unit 110 and out of the hollow block transported away in the direction of rolling W in the pipe rolling mill.

FIG. 2 illustrates how the mandrel rod 210 is fixed/locked to the mandrel rod retaining head 112 at least using the first actuating element 120' and the second actuating element 120".

The first actuating element 120' in the form of the flap serves to lock the mandrel rod 210 in the groove 117 when the mandrel rod retaining head 112 with the mandrel rod 210 moves back in the axial direction from the pipe rolling mill 300. For this purpose, at the beginning of the retraction operation, the flap 120' is folded up from its lowered position in accordance with FIG. 2 into a constriction 212 on the outer circumference of the mandrel rod 210 into its raised position using the traction force applied by the actuating mechanism 150 to the first traction element 160', as shown in FIG. 11. Analogous to the thickened end 216, the flap 120' serves as a securing element for preventing uncontrolled movement of the mandrel rod 210 in the event of a sudden deceleration of the deceleration force exerted by the movable unit on the mandrel rod for pulling the mandrel rod 210 out of the hollow block in the pipe rolling mill. When the mandrel rod 210 is moved towards the pipe rolling mill 300, the flap 120' is typically folded downwards due to gravity, as described above.

The second actuating element 120" serves to secure the mandrel rod 210 in the radial direction. For this purpose, the second actuating element 120" is moved/extended from the rest position shown in FIG. 1 to the raised position above the mandrel rod 210 shown in FIG. 2. The movement into the raised position is effected using a compression spring 136, as described in more detail below with reference to FIG. 5. In its raised position, the second actuating element limits movement of the mandrel rod 210 in the radial direction, i.e. in particular the second actuating element 120" prevents the mandrel rod 210 from lifting out of the groove 117/from the third actuating element 120'''. The second actuating element 120" is preferably designed, as shown in FIG. 2, in the form of an asymmetrical polygonal plate or is adapted to the diameter of the mandrel rod 210 used in each case by means of inserts or the like. The individual straight sections on the circumference of the second actuating element in each case have a different shortest distance to the center axis 124 of the second actuating element and are thus suitable for limiting the radial freedom of movement of mandrel rods 210 with different diameters. The second actuating element 120" is advantageously extended to its raised position in accordance with FIG. 2 both during a forward movement of the mandrel rod 210 towards the pipe rolling mill 300 and during a movement of the mandrel rod from the pipe rolling mill back.

The third actuating element 120''' shown in FIGS. 1 and 2 is, as indicated in FIG. 1, designed in the form of an eccentric shaft for pressing the mandrel rod 210 from below against the extended second actuating element 120". As long as the third actuating element 120''' is in its rest position, the mandrel rod 210 is generally not mounted without play in the radial direction in the groove 117—even when the second actuating element 120" is extended—because the second actuating element 120" does not necessarily touch the mandrel rod 210 in the groove 117 or even press it into the groove, even in the extended raised position in accordance with FIG. 2. Only by adjusting the mandrel rod 210 from below in the (radial) direction towards the extended second actuating element 120" using the eccentric shaft or a similar adjustable device is the mandrel rod 210 adjusted/aligned with the rolling center of the pipe rolling mill 300, such that the mandrel rod 210 is then aligned with the center of the pipe rolling mill. The eccentric shaft as the third actuating element is typically turned manually from its rest position to the raised position and back.

Figure 3:
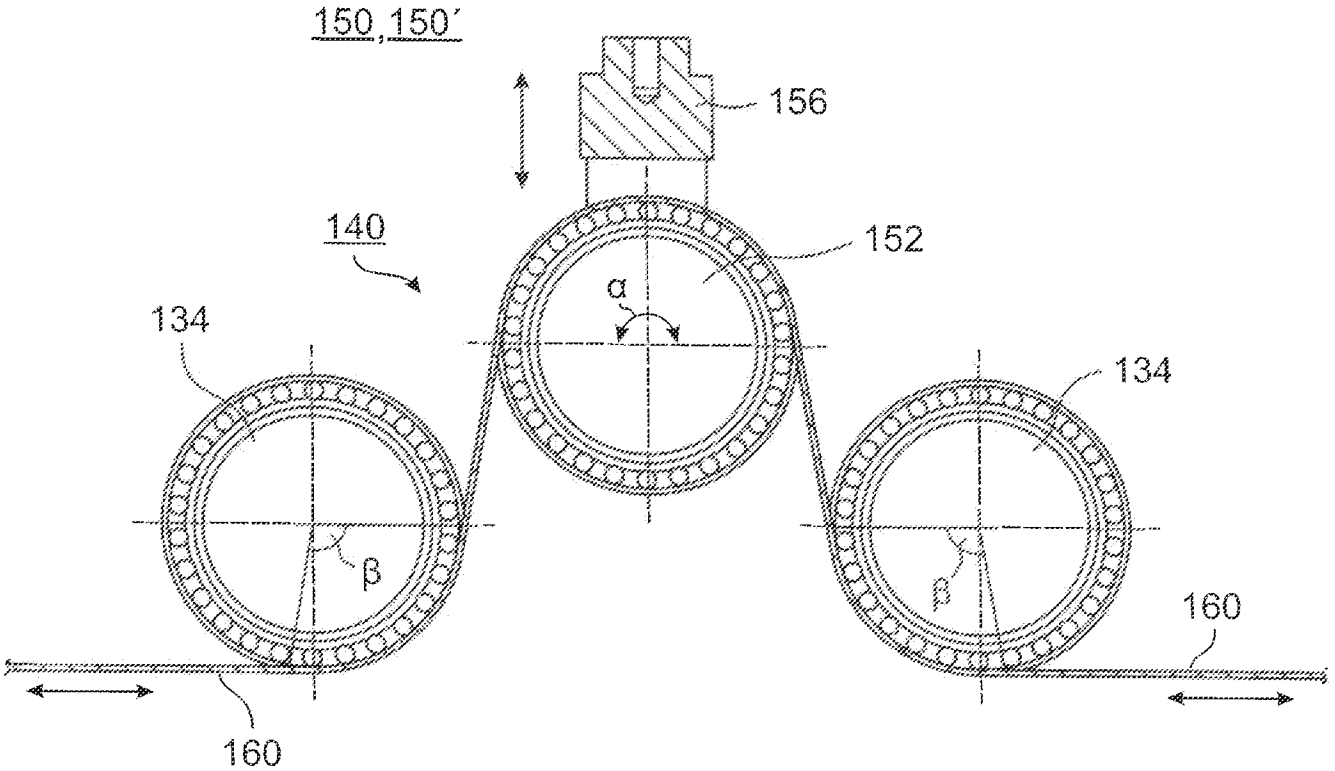
FIG. 3 shows an exemplary embodiment of the activating unit with a displaceable deflection element.

FIG. 3 illustrates the actuating mechanism 150. The mechanism shown there preferably applies in equal measure to the actuating mechanism for the first and the second exemplary embodiment. The actuating mechanism 150 serves to apply a traction force to the traction element 160. For this purpose, the actuating mechanism 150 has at least one displaceably mounted deflection element 152, preferably in the form of a deflection roller or guide nozzle. In accordance with FIG. 3, the displaceable deflection element 152 can be displaced in accordance with the vertical double arrow at least with one movement component in, for example, a vertical direction, i.e. transversely to the horizontal main direction of the traction element. The actuating mechanism 150 engages with the traction element 160 in such a manner that the traction element wraps around the displaceable deflection element 152 at least in an angular range $\alpha$. The displacement of the deflection element 152 can be effected manually or using a drive device 156. With the aforementioned displacement of the displaceable deflection element 152 at least with one component transverse to the main course of the respective traction element 160, for example in the horizontal direction, as shown in FIG. 3, a desired traction force is applied/exerted on the traction element 160. In addition to the at least one displaceable deflection element 152, the actuating mechanism in accordance with FIG. 3 can also have at least one, but preferably two, further fixed deflection elements 134, which are arranged in front of and/or behind the displaceable deflection element 152 in the direction of travel of the traction element 160 and are wrapped around by the traction element 160 at least in an angular range $\beta$. Other positions of the deflection elements relative to one another with resulting different wrap angles are possible and also enable other directions of movement of the actuating mechanism 150.

The actuating mechanism shown in FIG. 3 with the three deflection elements shown by way of example is part of an activating unit 140, which is arranged in a stationary manner relative to the movable unit 110. The deflection elements 134 that are arranged in a fixed position but are rotatably mounted serve to guide the traction element 160 to the movable deflection element 152 with as little friction as possible and away from it. They also ensure that the movement energy, i.e. traction force, introduced into the traction element 160 by the displaceable deflection element 152 is also introduced into the traction element 160 as far as possible and is not dissipated in an undesired displacement of the traction element 160.

In summary, the actuating mechanism 150 shown in FIG. 3 serves, on the one hand, as a tensioning device for the traction element 160, because it exerts a traction force on the traction element 160 through its movement/through the transmission of its movement energy. On the other hand, the actuating mechanism 150 also serves as a buffer device for the traction element 160, because it temporarily stores a partial length/a change in length of the traction element as a belt length.

Figure 4:
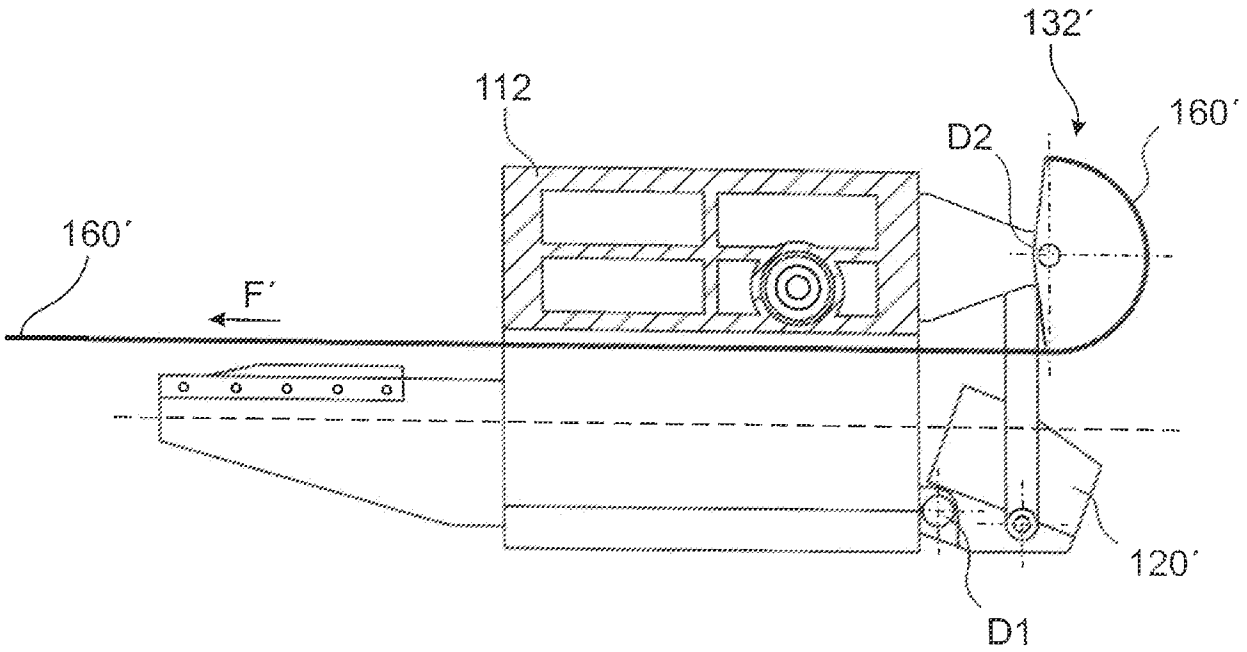
FIG. 4 shows a first exemplary embodiment of the actuator for adjusting a first actuating element.

FIG. 4 shows a side view of the mandrel rod retaining head in accordance with FIGS. 1 and 2. The gear mechanism for controlling the first actuating element 120' in the form of the flap, which is mounted in a pivotable manner about the axis of rotation D1, can be easily seen. The lever 132'/the rope pulley, on which the first traction element 160' is wound to some extent, can also be seen. The rope pulley 132' is in articulated mechanical connection with the flap 120' via a lever. As soon as a first traction force F' is exerted on the first traction element 160' using the actuating mechanism 150 in accordance with FIG. 3, the rope pulley 132' in FIG. 4 is rotated clockwise over a certain angular range. The mechanical coupling with the flap 120' causes the flap 120' to be pulled up from its folded down lowered position shown in FIG. 4 into its raised position shown in FIG. 11, preferably into the constriction 212 on the surface of the mandrel rod 210 shown in FIG. 2.

Figure 5:
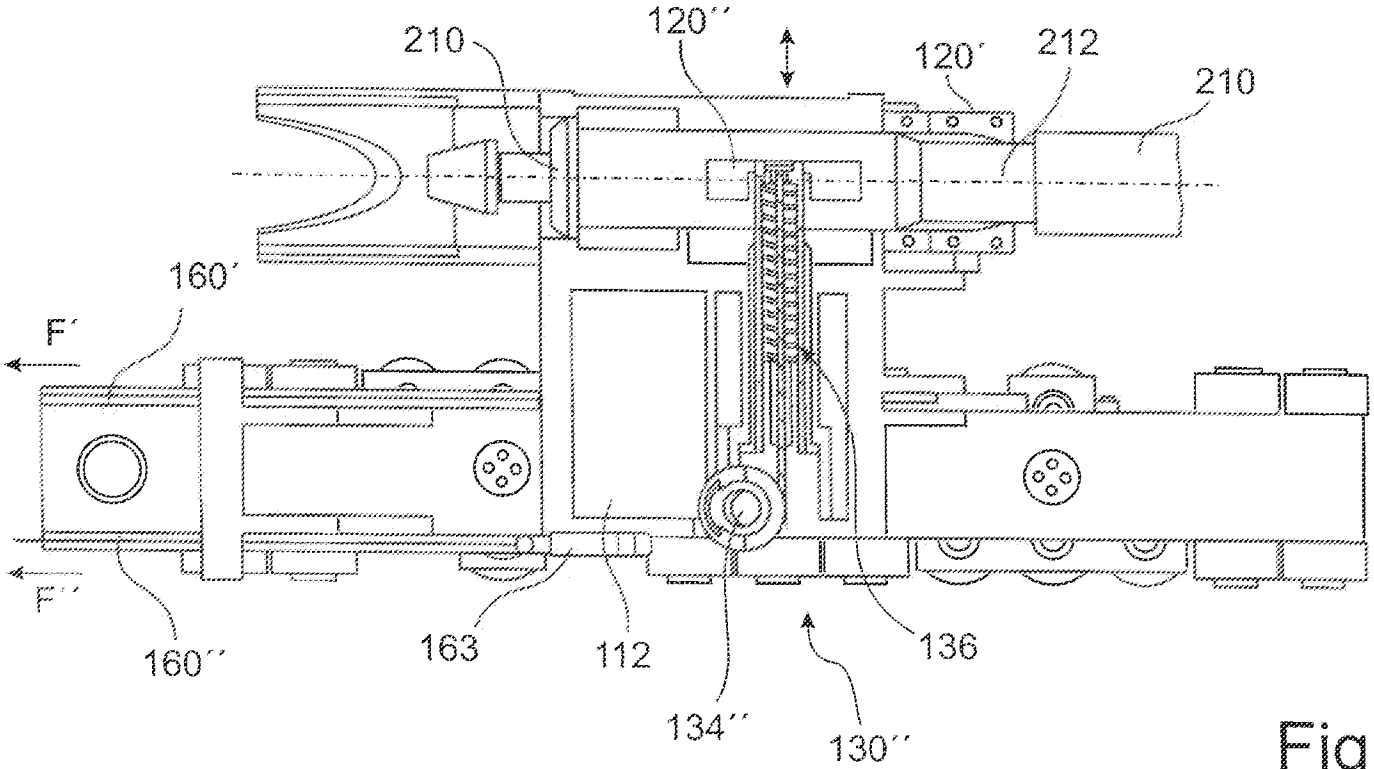
FIG. 5 shows a second exemplary embodiment of the actuator for adjusting a second actuating element in a plan view.

FIG. 5 illustrates a second actuator 130" for adjusting the second actuating element 120" in the form of the specified polygonal plate. In this exemplary embodiment in accordance with FIG. 5, the second actuator has a compression spring 136. The second traction element 160" is provided for tensioning the compression spring. The compression spring 136 exerts a pretensioning on the second traction element 160". If a traction force F", which is superimposed on the oppositely directed pretensioning that may be present, is exerted on the second traction element 160" using a second actuating mechanism, which may be of identical design to the first actuating mechanism shown in FIG. 3, the compression spring 136 is contracted and the second actuating element fastened to the end face in the form of the polygonal plate 120" is retracted from its raised position shown in FIG. 5 into its retracted position shown in FIG. 1. Conversely, a reduction of the traction force, in particular the application of no traction force to the second traction element 160", causes a relaxation of the compression spring 136 and thus a reverse displacement of the second actuating element 120" from the retracted position to the raised position above the mandrel rod 210 shown in FIG. 5. Given that the compression spring is arranged in a direction transverse to the main displacement direction of the second traction element 160", a fixed deflection element 134" in the form of a deflection roller is provided in the second actuator 160" in accordance with FIG. 5 for the corresponding deflection of the traction element 160" and the traction force F" exerted thereon. A damping element 163 can be installed in the traction cable in order to dampen any sudden force effects on the traction cable. The same applies to the first traction element 160'.

Figure 6:
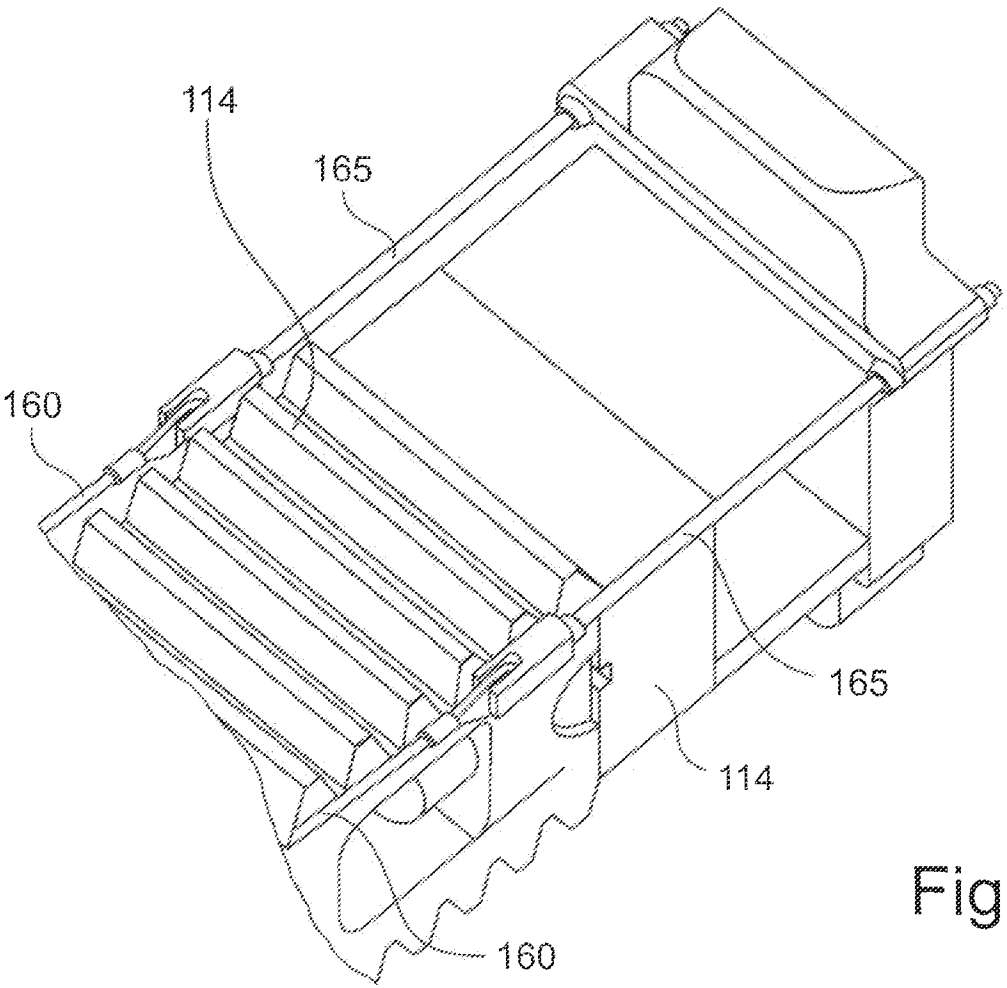
FIG. 6 shows an exemplary embodiment of a compensation element for the traction element.

FIG. 6 shows the aforementioned toothed rack 114, to which the mandrel rod retaining head 112 is firmly connected. The toothed rack 114 is moved translationally in its longitudinal direction using the pinion drive device 115 in accordance with FIG. 1. As the toothed rack is moved, the mandrel rod retaining head 112 fastened thereto is also moved in the longitudinal direction of the toothed rack towards and away from the pipe rolling mill, as described above. In addition to the toothed rack 114, the two traction elements 160 are also shown in FIG. 6. In addition, the compensation elements 165, for example in the form of spindles, are shown for applying a pretensioning (in addition to the pretensioning due to the weight force with the first actuating element 120' and/or to the pretensioning due to the compression spring 136 in the second actuating element 120") to the traction elements 160 and/or for compensating for an undesired change in length of the traction elements 160. The compensation elements can be used to adjust the actuating elements.

For all deflection rollers, it is advisable to design them in such a manner that they have a mass concentration in their respective centers, because such design enables the inertia element of the individual deflection rollers to be kept small. The advantage mentioned above of a damping element in the traction element can alternatively also be realized by designing the traction element to be elastic to some extent.

Furthermore, it is advantageous if interchangeable connections are provided at at least one end of the traction element 160 for easy detachment and optional replacement of the traction element as an interchangeable part from the movable unit, the actuator, or the actuating element and/or the mainland.

Various monitoring devices can advantageously be assigned to the system. For example, a monitoring device 170 can be configured to monitor the position, speed, or acceleration of the movable unit 110. A further monitoring device 180 can be provided for monitoring wear, abrasion, or undesirable elongation of the traction element 160. All monitoring devices can operate mechanically, optically, or electronically.

As mentioned above, as a first exemplary embodiment, the figures show the system by way of example in the form of a mandrel rod retaining device in the pipe rolling mill 300 with the movable unit 110 as mandrel rod retaining head 112 with the groove 117 for accommodating the mandrel rod 210.

The system 100 is operated by exerting a traction force on the at least one traction element 160 using the at least one actuating mechanism 150 operated manually or using a drive device 156 for actuating the at least one actuator 130 for the at least one actuating element 120. In accordance with a first exemplary embodiment of the method, the traction force F can be exerted on the traction element 160 both during the movement of the movable unit 110 and during its standstill, independently of the respective relative position of the movable unit and the activating device with the actuating mechanism to one another.

Figure 7:
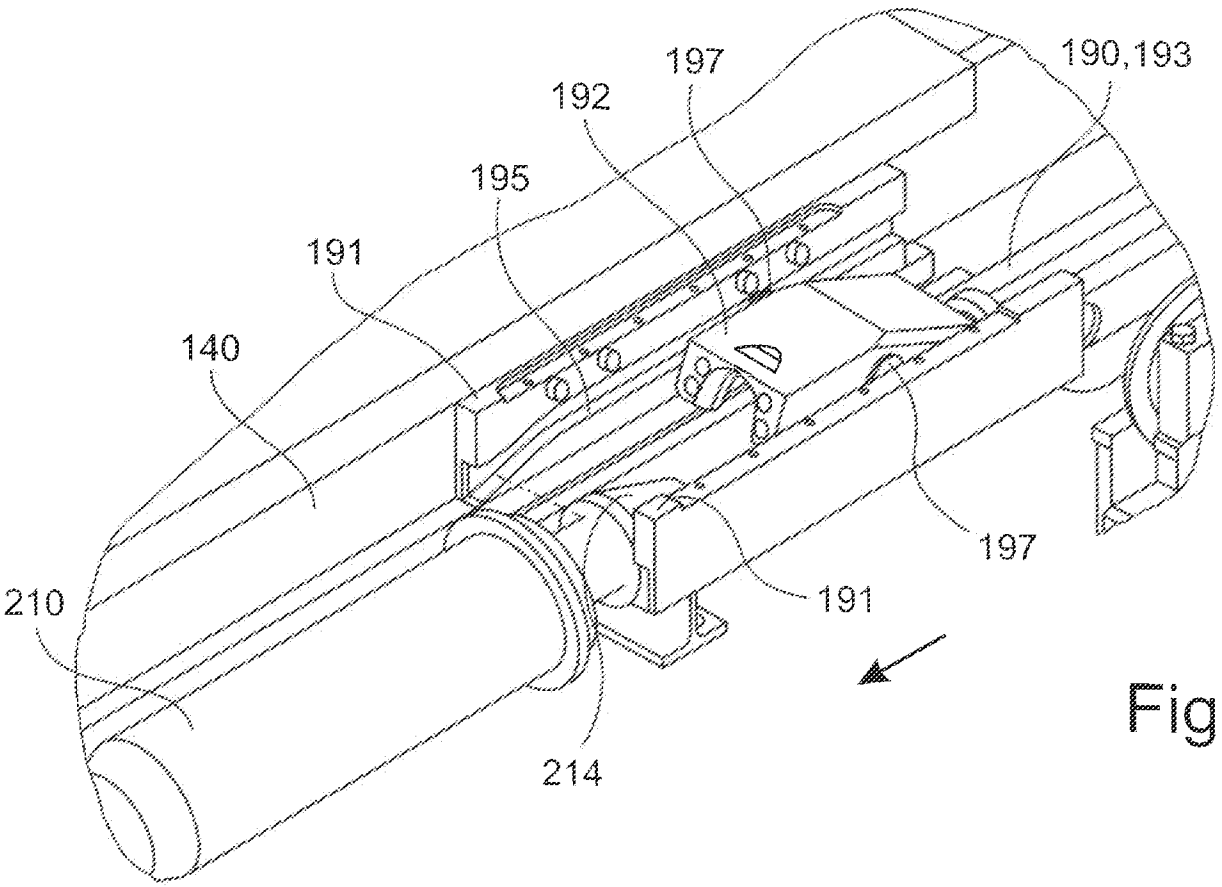
FIGS. 7 to 9 show the coupling of a push-in device to the head of a mandrel rod
Figure 8:
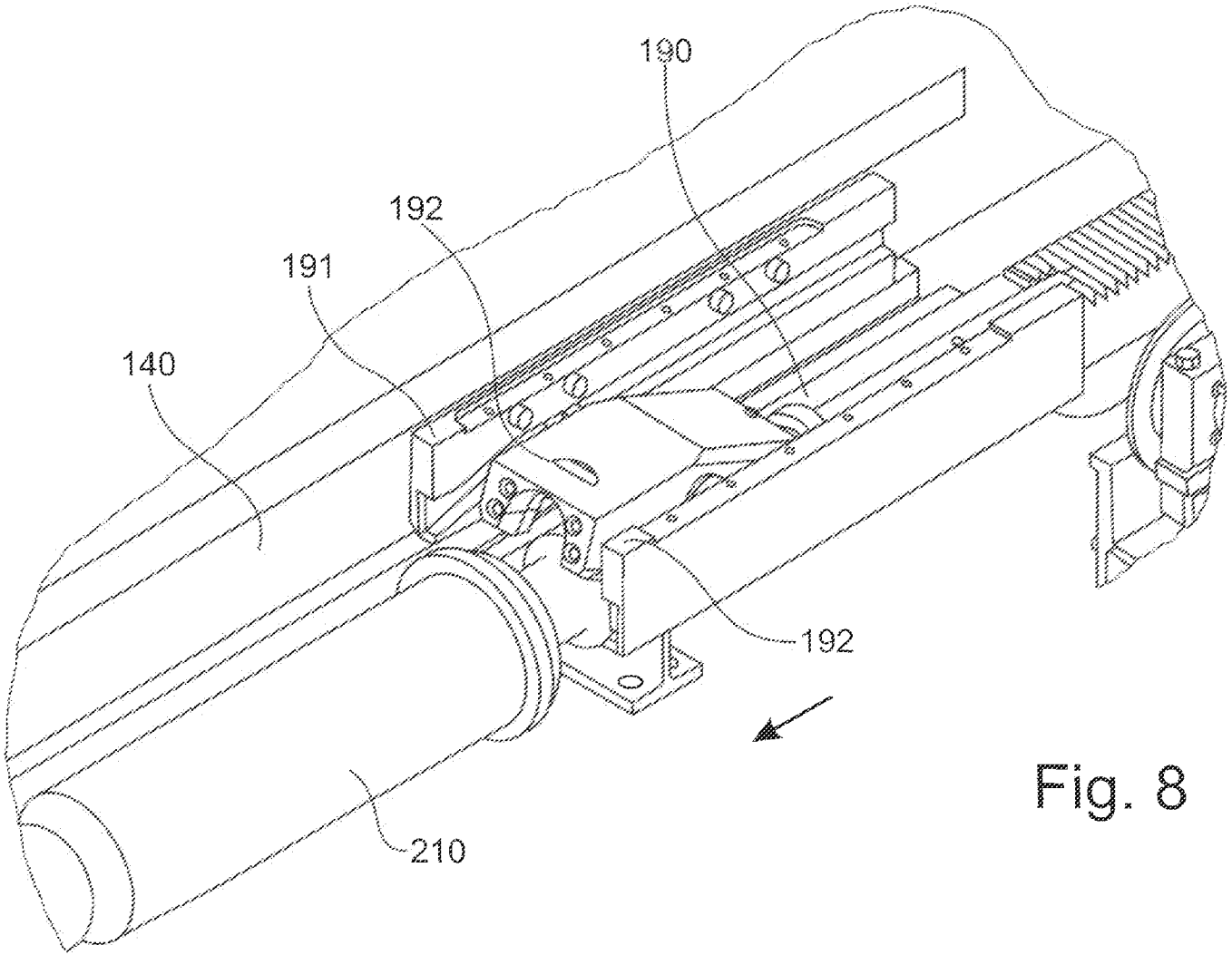
Figure 9:
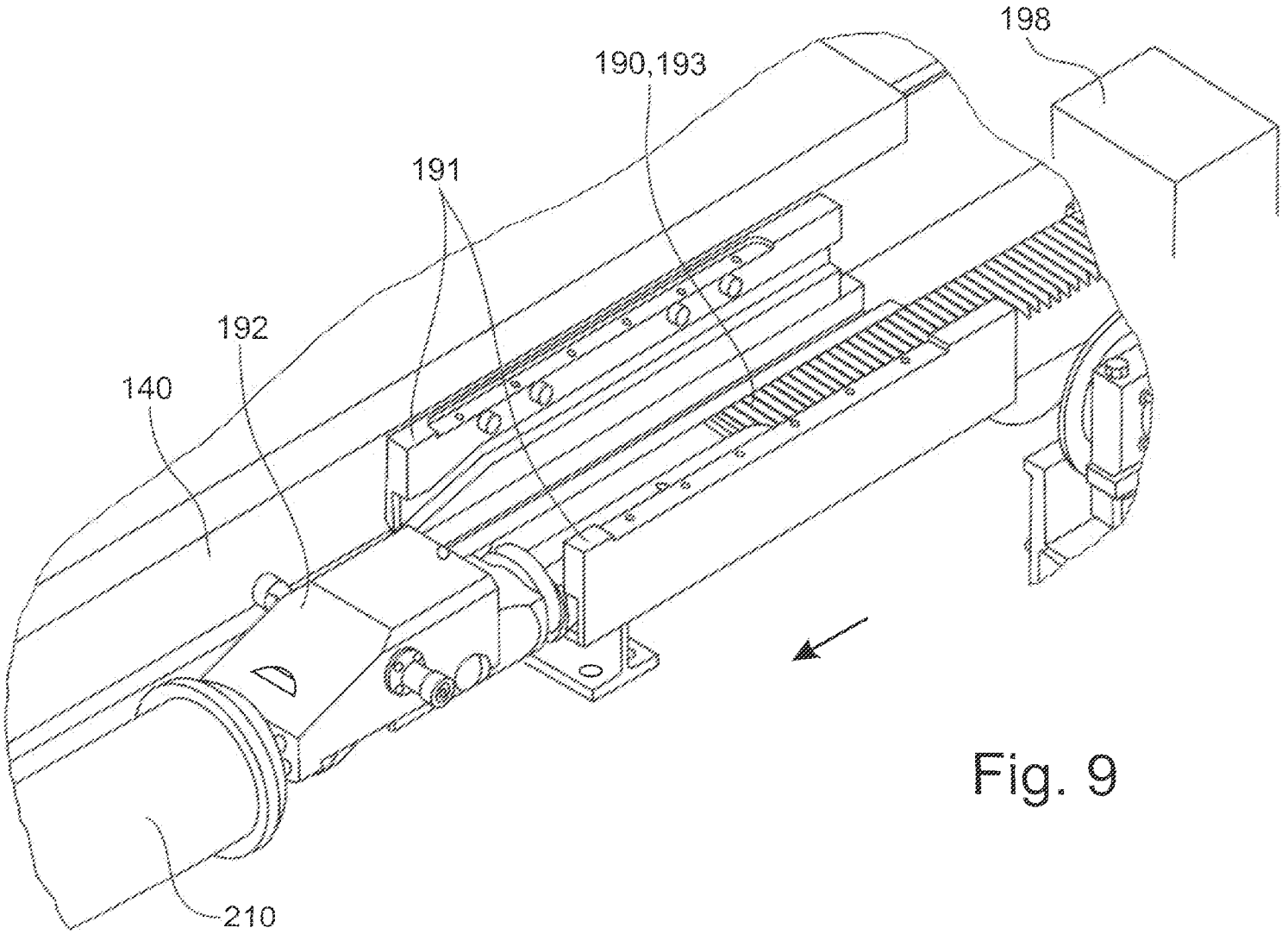
Figure 10:
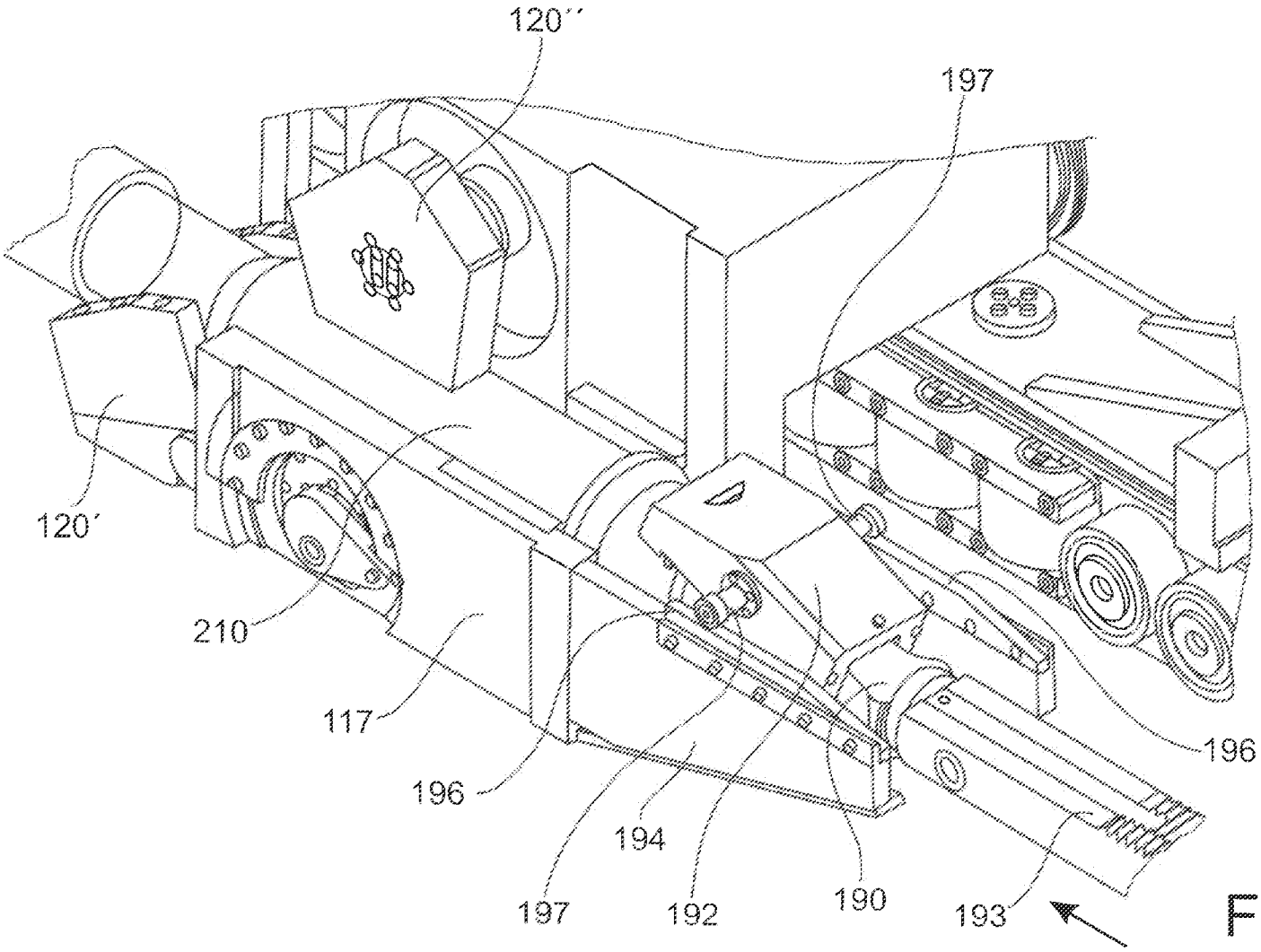
FIG. 10 shows the uncoupling of the push-in device from the mandrel rod head.

FIGS. 7 to 9 illustrate the coupling of a pusher 190, also known as a push-in device, to the mandrel rod 210. The pusher 190 consists of a rod 193, at one end of which a locking flap 192 mounted in a hinged manner is attached. The push-in device 190 is displaceable in the axial direction of the rod via the rod 193, for example a toothed rack, using a drive device 198. The drive device 198 is in engagement with the rod 193, in particular the toothed rack. At least at its end with the locking flap, the pusher 190 is displaceably mounted within a first pusher coupling device 191. The pusher coupling device 191 is fastened, for example, to the stationary activating unit 140, preferably in an axially adjustable manner. It is installed on the activating device 140 in such a manner that the pusher 190 is displaceably mounted within it parallel to the toothed rack 114 of the movable unit 110, in order to have stepless adjustment options.

FIG. 7 shows the pusher 190 with the locking flap 192 open. The opening of the locking flap 192 shown is realized by guide pins 197, optionally with sliding or roller guidance, being forcibly guided on both sides of the locking flap in a first slot guide 195 on the inner sides of the first pusher coupling device 191 in such a manner that the locking flap 192 is opened at the position shown in FIG. 7. In order to couple the pusher 190 to the head 214 of the mandrel rod, which is shaped for example like a truncated cone, the locking flap is moved increasingly further towards the mandrel rod head 214 via the rod 193 within the first pusher coupling device 191, as illustrated in the further FIGS. 8 and 9. Due to the suitable first slot guide 195 shown in FIGS. 7 to 9, the locking flap 192 is increasingly lowered further from its open position as it approaches the mandrel rod head 214, until it finally couples to the mandrel rod head 214 and locks to it.

For this purpose, the first slot guide 195 has a raised straight section in the push-in direction (see arrows in the figures), such that the locking flap is always open if its guide pins 197 slide along it. At its end facing the groove 117, the first slot guide 195 has a ramp section inclined downwards in the push-in direction, which ensures that the locking flap, when the pusher approaches the head 214 of the mandrel rod 210, lowers onto the head 214, as described above.

In a subsequent method step, the mandrel rod 210 is then axially displaced into the groove 117 of the movable unit 110 using the coupled pusher 190. FIGS. 7 to 10 show this direction of displacement from right to left. Shortly before the mandrel rod 210 has reached its target position in the groove 117, with which the mandrel rod strikes the stop 119 with its thickened end 216, the guide pins 197 of the locking flap 192 meet the start of a second slot guide 196 of a second pusher coupling device 194. The second slot guide 196 is designed in such a manner that the guide pins 197 and thus also the locking flap 192 are lifted if the pusher 190 is pushed into the second pusher coupling device 194 from the right, i.e. coming from the first coupling device 191. Lifting the locking flap unlocks the connection between the pusher 190 and the mandrel rod 210, in particular the head 214 of the mandrel rod 210. The mandrel rod 210 can then still be pushed in the axial direction into its actual target position within the groove 117. However, when the pusher 190 is retracted, its locking flap 192 initially remains so wide open that it is no longer in engagement with the head 214 of the mandrel rod 210. Only when the pusher 190 has retracted so far that the locking flap 192 is no longer above the head 214 of the mandrel rod is it transferred back to its lowered position.

The second slot guide 196 is designed in such a manner that, in interaction with the guide pins 197 of the locking flap, it realizes its movement as described and desired. More precisely, for this purpose, the second slot guide 196 is initially provided at its end remote from the groove with a ramp section that rises in the push-in direction (from right to left in the figures), which then changes into a straight section of constant height as it approaches the groove 117. In the ramp section, the guide pins 197 and thus also the locking flap are raised to the height level represented by the straight section. When the pusher is displaced along the straight section, the locking flap remains constantly open.

FIGS. 7 to 10 illustrate the insertion of the mandrel rod 210 in the push-in direction into the groove 117 on the mandrel rod retaining head 112. Thereby, the first pusher coupling device serves to couple the pusher 190 to the mandrel rod 210 and the second pusher coupling device is used to uncouple the pusher from the mandrel rod. However, the process can also be reversed, i.e. the mandrel rod 210 is then retracted from the groove 117. The second pusher coupling device then serves to couple the pusher 190 and the first pusher coupling device serves to uncouple the pusher 190 from the mandrel rod 210.

LIST OF REFERENCE SIGNS

100 System
110 Movable unit
112 Mandrel rod retaining head
114 Toothed rack
115 Drive device of toothed rack and mandrel rod retaining head
117 Groove
119 Stop
120 Actuating element
120' First actuating element, in particular a flap
120" Second actuating element, in particular a polygonal plate
120''' Third actuating element, in particular eccentric adjuster
124 Center axis of second actuating element
130 Actuator
130' First actuator
130" Second actuator
132' Lever
134 Fixed deflection element
134" Fixed deflection element
136 Spring
140 Activating unit
150 Actuating mechanism
152 Displaceable deflection element
152' Displaceable deflection element
156 Drive device, actuating mechanism
160 Traction element
160' First traction element
160" Second traction element
163 Damping element
165 Compensation element
170 Monitoring device
180 Further monitoring device
190 Push-in device (=pusher)
191 First pusher coupling device
192 Locking flap
193 Rod, toothed rack, pusher
194 Second pusher coupling device
195 First slot guide
196 Second slot guide
197 Guide pins of locking flap
198 Pusher drive device
210 Mandrel rod
212 Constriction of the mandrel rod
214 Head of the mandrel rod
216 Thickened end of the mandrel rod head
220 Hollow block
300 Pipe rolling mill
α Angular range
β Angular range
D1 Pivot axis of flap
D2 Pivot axis of lever 132'/rope pulley
F Traction force
← Push-in direction towards the groove 117 (=direction of the rolling force W)

The invention claimed is:

1. A mandrel rod retention device in a pipe rolling mill, the mandrel rod retention device comprising:

a movable unit (110) having a mandrel rod retaining head (112) with a groove (117) for accommodating a mandrel rod (210), an actuating element (120), and an actuator (130) for the actuating element;

an activating unit (140) having an actuating mechanism (150) for actuating the actuator for the actuating element, the activating unit (140) being installed in a stationary manner relative to the movable unit; and a traction element (160) for transmitting movement energy of the actuating mechanism (150) in form of a traction force to the actuator (130) on the movable unit (110) for adjusting the actuating element (120), wherein the traction element (160', 160") is a rope, a wire, a chain, a toothed belt, or a V-belt.

2. The mandrel rod retention device according to claim 1, wherein the actuator (130) is a gear mechanism, wherein the actuating element (120) is arranged on an output side of the gear mechanism, and wherein the traction element (160) is fastened on an input side of the gear mechanism to a lever (132) of the gear mechanism for adjusting the actuating element (120) using the gear mechanism.

3. The mandrel rod retention device according to claim 2, wherein the actuating element (120) is moved into a retracted position by gravity; and wherein the actuating element (120) can be displaced from the retracted position into a raised position using the traction element (160), driven by the movement energy of the actuating mechanism (150) and the gear mechanism.

4. The mandrel rod retention device according to claim 2, wherein the traction element (160) is a rope or a wire and the lever (132) is a rope pulley, a drum, or a guide nozzle, or wherein the traction element (160) is a toothed belt or V-belt and the lever (132') is a pulley.

5. The mandrel rod retention device according to claim 1, wherein the actuator (130) is a compression spring for positioning the actuating element (120) into a raised position using a spring force of the compression spring; and wherein the traction element (160) is fastened with an actuating element side end to the actuator (130) or to the compression spring such that the actuating element (120) can be displaced from the raised position into a retracted position counter to the spring force using the traction element (160) when the movement energy of the actuating mechanism (150) is transmitted.

6. The mandrel rod retention device according to claim 5, wherein the actuator (130) has a fixed deflection element (134) for the traction element (160), and wherein the traction element (160) is a rope or a wire and the fixed deflection element (134) is a rotatably mounted roller or drum or a guide nozzle or the traction element (160) is a chain or a toothed belt and the fixed deflection element (134) is a pinion.

7. The mandrel rod retention device according to claim 2, wherein the traction element (160) is fixed with an end facing away from the actuating element (120') on the movable unit (110), and wherein the actuating mechanism (150) of the activating unit (140) is a tensioning and buffering device for the traction element (160) and is in engagement with the traction element between an actuating element side end and an end of the traction element (160) facing away from the actuating element.

8. The mandrel rod retention device according to claim 1, wherein the actuating mechanism (150) has a displaceably mounted deflection element (152) in form of a deflection roller or guide nozzle, wherein the actuating mechanism (150) is in engagement with the traction element (160) in such a manner that the traction element (160) wraps around the displaceably mounted deflection element in an angular range ($\alpha$), and wherein the displaceably mounted deflection element (152) is displaceably mounted manually or using a drive device (156) for applying the traction force to the traction element.

9. The mandrel rod retention device according to claim 8, wherein the actuating mechanism (150) or the activating unit (140) has, in addition to the displaceably mounted deflection element (152), two further fixed deflection elements (134), which are arranged in front of and behind the displaceably mounted deflection element (152) and are wrapped around by the traction element (160) in a further angular range (B).

10. The mandrel rod retention device according to claim 9, wherein at least one of the two further fixed deflection elements (134) and/or the displaceably mounted deflection element (152) has a mass concentration in its center.

11. The mandrel rod retention device according to claim 1, wherein the traction element (160) is elastic and/or contains a damping element (163).

12. The mandrel rod retention device according to claim 1, wherein interchangeable connections are provided at an end of the traction element (160) for detachment and optional replacement of the traction element (160) as an interchangeable part from the movable unit (110), the actuator (130), the actuating element (120) and/or the activating unit.

13. The mandrel rod retention device according to claim 1, further comprising a monitoring device (170) for monitoring a position, speed, or acceleration of the movable unit (110).

14. The mandrel rod retention device according to claim 13, further comprising a further monitoring device (180) for monitoring wear, abrasion, or elongation of the traction element (160).

15. The mandrel rod retention device according to claim 14, wherein the monitoring device (170) and/or the further monitoring device (180) operates mechanically, optically, or electronically.

16. The mandrel rod retention device according to claim 1, further comprising a compensation element (165) for compensating undesired changes in length of the traction element (160) compared to a delivery state and/or for adjusting the actuating element.

17. The mandrel rod retention device according to claim 1, wherein the actuating element (120) comprises an axial locking element (120') on the mandrel rod retaining head for securing the mandrel rod (210) in the groove (117) against axial displacement, the axial locking element being a flap for engaging in a constriction (212) on an outer circumference of the mandrel rod (210); and/or wherein the actuating element comprises a radial locking element (120") on the mandrel rod retaining head for holding the mandrel rod (210) in the groove (117) against a radial force effect, the radial locking element being a polygonal plate that is mounted so as to be rotatable and axially displaceable.

18. A mandrel rod retention device in a pipe rolling mill, the mandrel rod retention device comprising:

a movable unit (110), having a mandrel rod retaining head (112) with a groove (117) for accommodating a mandrel rod (210), an actuating element (120), an actuator (130) for the actuating element;

an activating unit (140) having an actuating mechanism (150) for actuating the actuator for the actuating element, the activating unit (140) being installed in a stationary manner relative to the movable unit;

a traction element (160) for transmitting movement energy of the actuating mechanism (150) in form of a traction force to the actuator (130) on the movable unit (110) for adjusting the actuating element (120);

a pusher (190) for axially pushing the mandrel rod (210) into the groove (117) on the movable unit (110);

a first pusher coupling device (191) having a first slot guide (195) for coupling or uncoupling the pusher (190) to/from a head (214) of the mandrel rod (210); and a second pusher coupling device (194) with a second slot guide (196) on an inlet side of the groove (117) for uncoupling or coupling the pusher (190) from/to the mandrel rod (210).

19. The mandrel rod retention device according to claim 18, wherein the pusher (190) has a toothed rack (193), and, at an end facing the groove (117), a hinged locking flap (192) with guide pins (197), which project laterally from the hinged locking flap for engaging in the first and second slot guides (195, 196).

20. The mandrel rod retention device according to claim 19, wherein the first slot guide is attached to the activating unit in an axially adjustable manner, and wherein the first slot guide (195) is attached to inner sides of the first pusher coupling device (191) and has an upright straight section and a sloping ramp section at its end on a groove side, for transferring the guide pins (197) guided on it from a high level to a lower level for lowering the hinged locking flap (192) onto the head (214) of the mandrel rod when the pusher (190) moves in a push-in direction towards the groove (117), and wherein the second slot guide (196) is attached to the inner sides of the second pusher coupling device (194) and is designed at its end remote from the groove in the form of a ramp that rises in the push-in direction and that leads to a raised level for lifting the hinged locking flap (192) and thus for uncoupling the pusher (190) from the mandrel rod (210) when the pusher (190) moves towards the groove (117).

21. A method for operating the mandrel rod retention device according to claim 20, comprising:

exerting the traction force on the traction element (160) using the actuating mechanism (150) operated manually or using a drive device (156) for actuating the actuator (130) for the actuating element (120).

22. The method according to claim 21, further comprising exerting the traction force on the traction element (160) during a movement of the movable unit (110).

23. The method according to claim 21, further comprising applying the traction force to the traction element (160) for actuating the actuator (130) for moving the actuating element (120) in the form of a flap from a rest position into a raised position, in which the flap engages in a constriction (212) on an outer side of the mandrel rod (210).

24. The method according to claim 21, further comprising applying the traction force to the traction element (160) for actuating the actuator (130) for transferring the actuating element (120) from an extended position above the mandrel rod (210) to a retracted position, or reducing or switching off the traction force on the traction element (160) for transferring the actuating element (120) from the retracted position to a raised position above the mandrel rod (210) in the groove (117).

25. The method according to claim 24, wherein the mandrel rod retention device comprises a further actuating element (120") configured as an eccentric shaft, the method further comprising rotating the eccentric shaft to raise the mandrel rod (210) from below toward an extended second actuating element (120") and thereby aligning the mandrel rod (210) with a rolling center of a downstream pipe rolling mill (300).

26. The method according to claim 21, further comprising pushing the mandrel rod (210) into the groove (117) at the mandrel rod retaining head (112) using a push-in device (190) before the mandrel rod is fixed in the groove (117) against axial and/or radial displacement in the groove (117) using the actuating element (120).

27. The method according to claim 26, further comprising initially moving the hinged locking flap (192) towards the head (214) of the mandrel rod (210) in an open state using the first slot guide (195) within the first pusher coupling device (191), and subsequently lowering the hinged locking flap (192), guided by the ramp section of the first slot guide (195) falling in the push-in direction, over the head (214) of the mandrel rod (210) to lock with the mandrel rod (210).

28. The method according to claim 26, further comprising uncoupling the pusher (190) from the mandrel rod (210) in a second pusher coupling device (194) assigned to the groove (117) by initially opening the hinged locking flap (192), and pushing the guide pins (197) up a ramp section of the second slot guide that rises in the push-in direction, until they are at a raised level that is associated with an opening of the hinged locking flap and thus with an unlocking of the pusher (190) from the mandrel rod (210).

29. The mandrel rod retention device according to claim 18, wherein the mandrel rod (210) is an expanding or piercing mandrel for expanding or reducing a forming cross-section of a primary product.

* * * * *